US005934693A

United States Patent [19]

Nicoletti

[11] Patent Number: 5,934,693

[45] Date of Patent: Aug. 10, 1999

[54] SKATE STRUCTURE, PARTICULARLY FOR AN IN-LINE ROLLER SKATE

[75] Inventor: Graziano Nicoletti, Treviso, Italy

[73] Assignee: Bauer Italia S.p.A., Treviso, Italy

[21] Appl. No.: 08/803,456

[22] Filed: Feb. 20, 1997

[30] Foreign Application Priority Data

Mar. 11, 1996 [IT] Italy ..... PD96A0064

[51] Int. Cl.[6] ..... A63C 17/06

[52] U.S. Cl. ..... 280/11.22; 280/11.26; 280/11.27

[58] Field of Search ..... 280/11.22, 11.23, 280/11.26, 11.27, 7.13, 11.19; 403/345, 375

[56] References Cited

U.S. PATENT DOCUMENTS

| | | | |
|---|---|---|---|
| 3,086,787 | 4/1963 | Wynche | 280/11.19 |
| 3,235,282 | 2/1966 | Bostick | 280/11.26 |
| 3,963,252 | 6/1976 | Carlson | 280/11.22 |
| 5,193,827 | 3/1993 | Olson | 280/7.13 |
| 5,533,740 | 7/1996 | Lin | 280/11.22 |
| 5,549,310 | 8/1996 | Meibock et al. | 280/11.22 |
| 5,690,344 | 11/1997 | Chen | 280/11.28 |

FOREIGN PATENT DOCUMENTS

| | | | |
|---|---|---|---|
| 2672812 | 8/1992 | France | 280/11.26 |
| 8701675 | 7/1987 | Netherlands . | |
| WO 9622818 | 1/1996 | WIPO . | |

*Primary Examiner*—J. J. Swann
*Assistant Examiner*—Michael Mar
*Attorney, Agent, or Firm*—Sughrue, Mion, Zinn, Macpeak & Seas, PLLC

[57] ABSTRACT

A skate structure for in-line roller skates includes front and rear blocks adapted to be connected to the toe portion and the heel portion, respectively of a skate shoe. A pair of elongated wheel support frame members are slidably connected to opposite sides of the front and rear blocks and a plurality of in-line wheels are rotatably supported between the frame members. The slidable connection between the frame members and the blocks is provided by a pair of longitudinally extending grooves formed in opposite sides of each of the front and rear blocks and an inwardly extending appendage on each of the frame members. The grooves and appendages have a mating configuration which will prevent lateral separation of the frame members from the blocks while permitting longitudinal sliding movement of the blocks relative to each other on the frame members to accommodate different size skate shoes prior to securing the blocks to the frame members.

1 Claim, 4 Drawing Sheets

SKATE STRUCTURE, PARTICULARLY FOR AN IN-LINE ROLLER SKATE

BACKGROUND OF THE INVENTION

The present invention relates to a skate structure, particularly for an in-line roller skate including a wheel-support frame with two sides, between which a plurality of wheels is supported.

In the specific technical field, wheel-support frames having a monolithic structure or produced by the joining of at most two half-frames are widely used. They are predominantly made of moulded plastics material or of light alloy and are arranged to be fixed to a shell of the skate, normally to the toe and heel portions of the shell.

A limitation attributable to frames of this type is their poor adaptability to footwear of different sizes. As a result, it is necessary to provide a respective wheel-support frame with dimensions such that it can be coupled correctly with and fixed to the toe and heel portions for each size of shell. This involves the need to provide different moulds and moulding apparatus.

SUMMARY OF THE INVENTION

The problem upon which the present invention is based is that of providing a skate structure which is designed structurally and functionally so as to overcome all of the problems complained of with reference to the prior art mentioned.

This problem is solved by the invention by means of a skate structure of the type indicated above, characterized in that the sides are structurally independent of one another and of at least one block, by means of which the sides are joined together and spaced apart to form the frame.

According to another characteristic of the invention, two blocks are provided for joining the sides together, the blocks being fixed in positions adjustable along the sides and constituting supports for the fixing of corresponding toe and heel portions of the shell. As a result the same wheel-support frame can advantageously be adapted to shells of different sizes both by adjusting the relative distance between the blocks and by replacing the sides with others of different sizes.

BRIEF DESCRIPTION OF THE DRAWINGS

The characteristics and advantages of the invention will become clearer from the following detailed description of two embodiments thereof, described by way of non-limiting example, with reference to the appended drawings, in which.

DETAILED DESCRIPTION OF THE INVENTION

Figure 1:
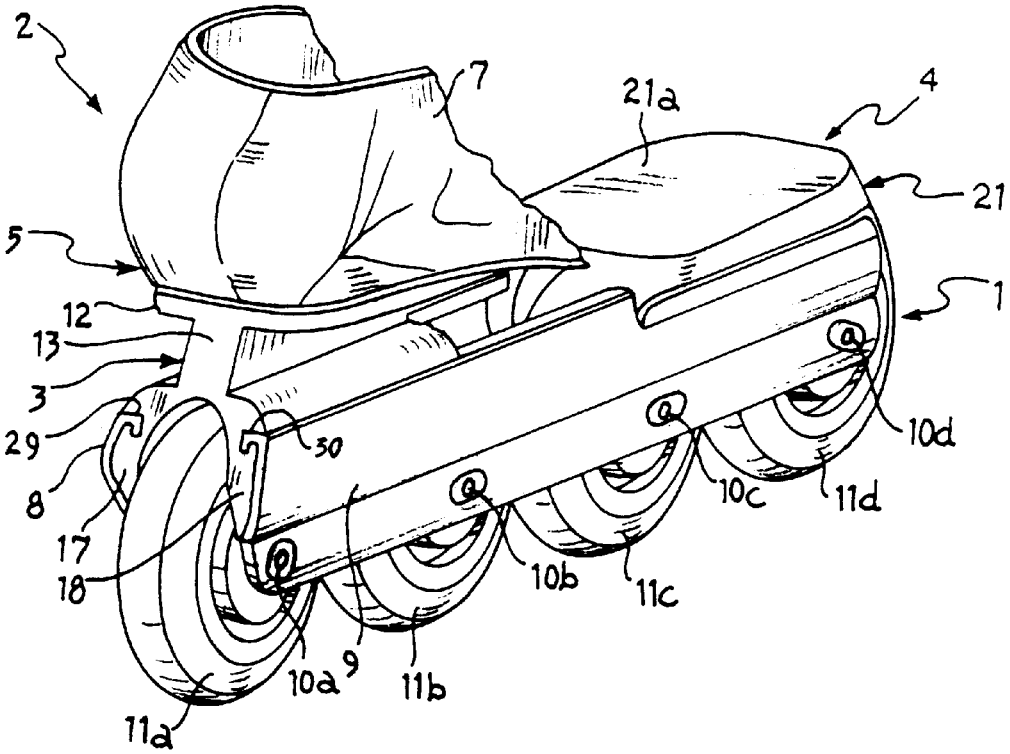
FIG. 1 is a perspective view of an in-line skate structure formed in accordance with the present invention.
Figure 3:
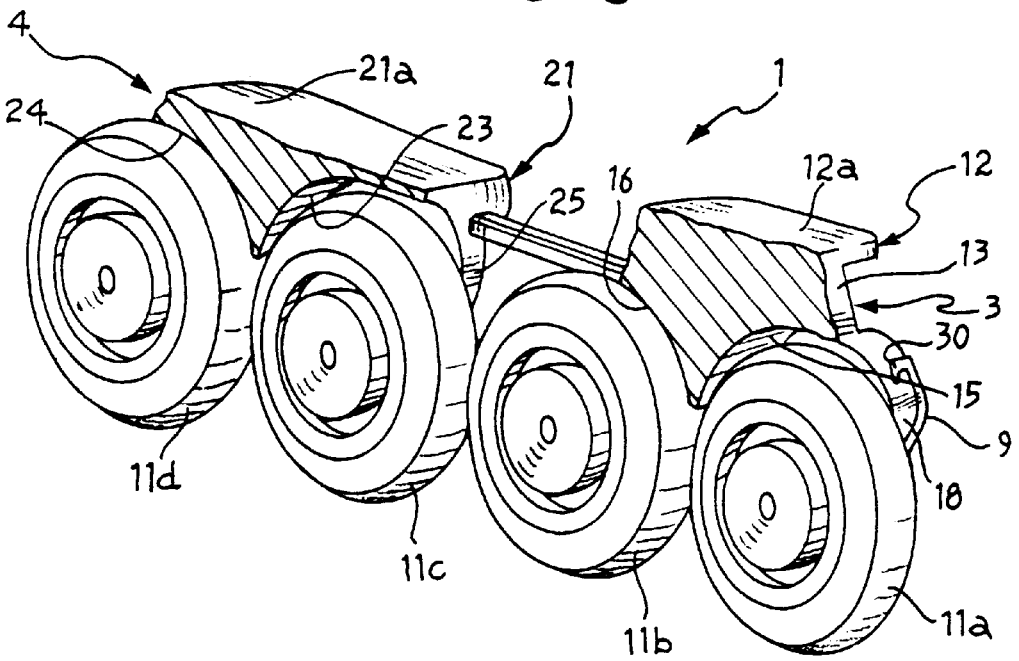
FIG. 3 is a partially-sectioned, perspective view of the skate structure of the preceding drawings.
Figure 2:
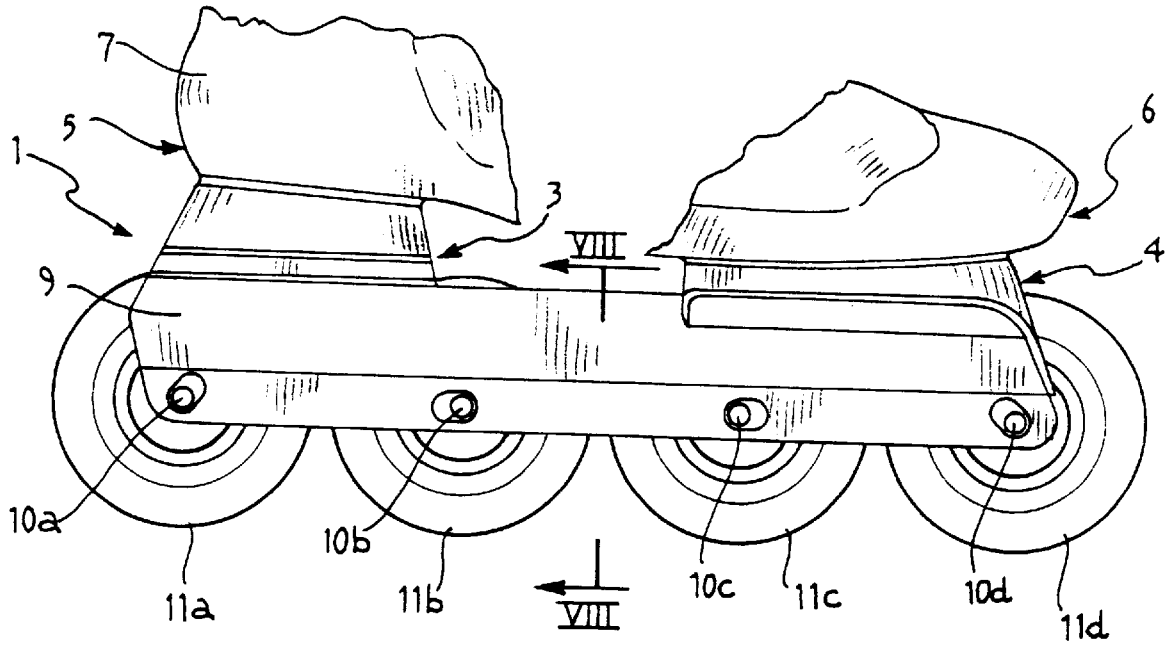
FIG. 2 is a side elevational view of the skate structure of FIG. 1.
Figure 8:
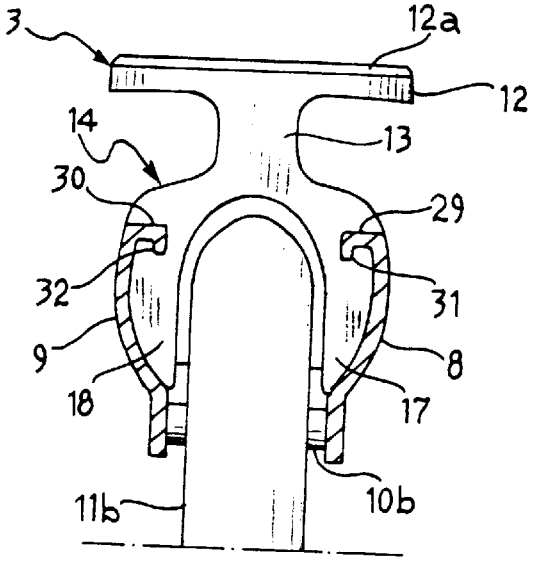
FIG. 8 is a section taken on the line VIII—VIII of FIG. 2.
Figure 4:
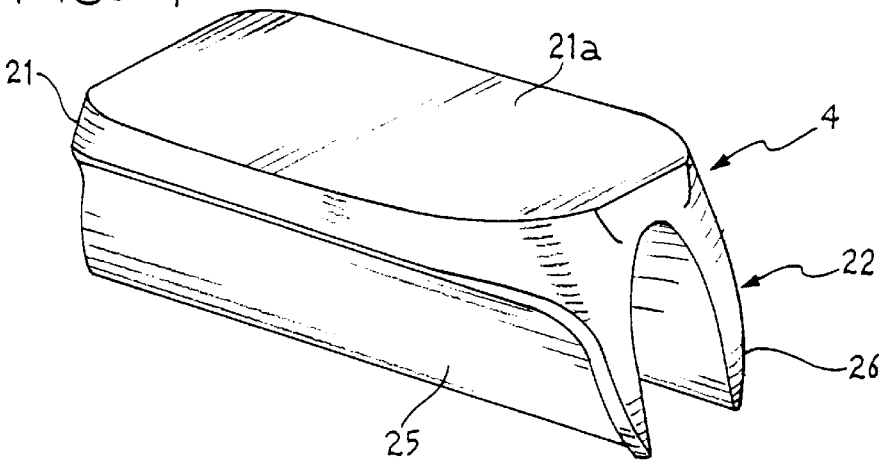
FIGS. 4 and 5 are a perspective view and a front elevational view of a detail of the skate of FIG. 1, respectively.
Figure 5:
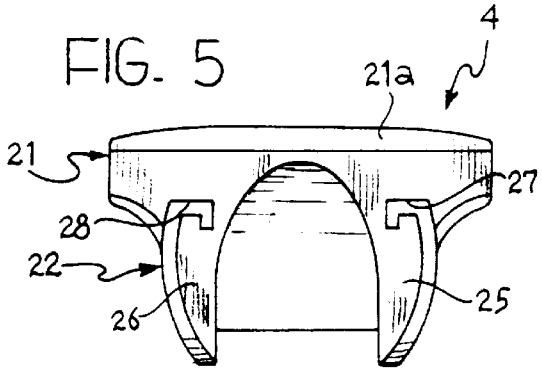
Figure 6:
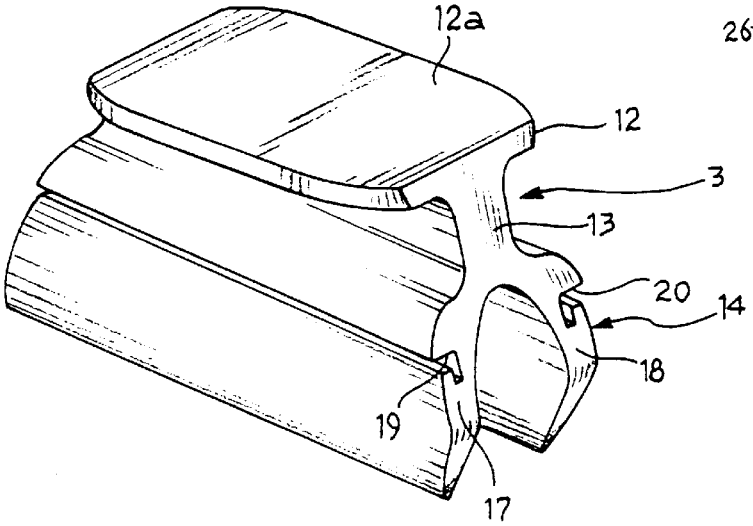
FIGS. 6 and 7 are a perspective view and a front elevational view of a further detail of the skate of FIG. 1, respectively.
Figure 7:
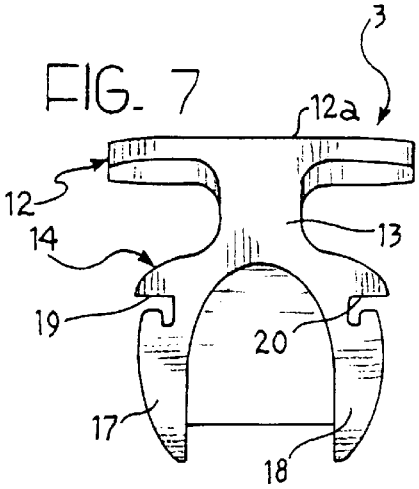
Figure 9:
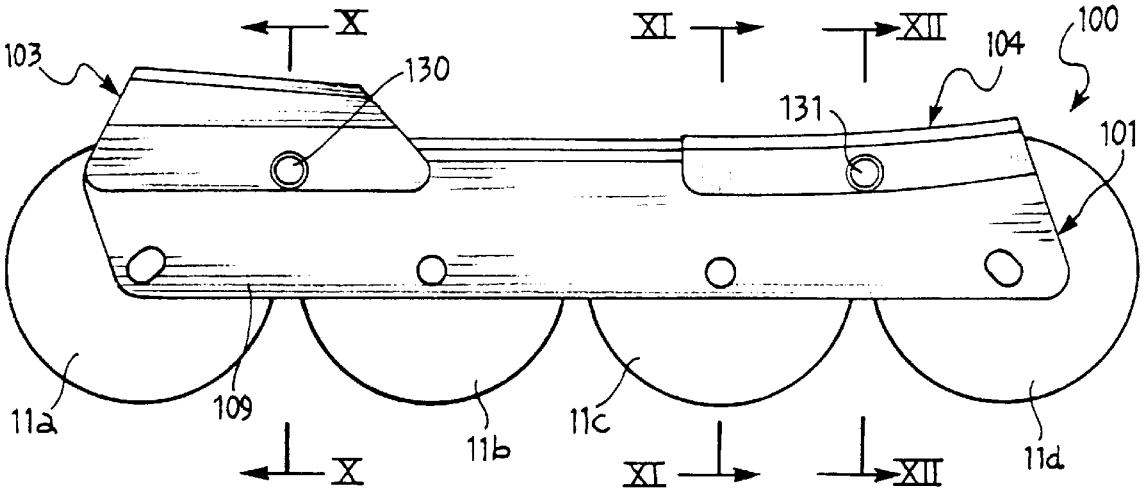
FIG. 9 is a side elevational view of a variant of the skate structure of the invention.
Figure 10:
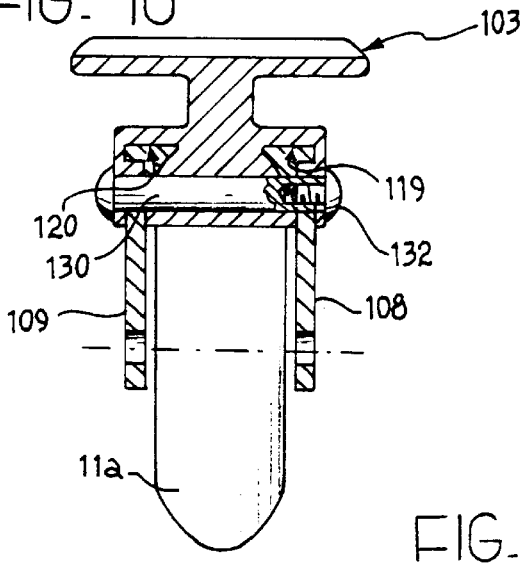
FIGS. 10, 11 and 12 are sections taken on the line X—X, XI—XI and XII—XII of FIG. 9, respectively.
Figure 11:
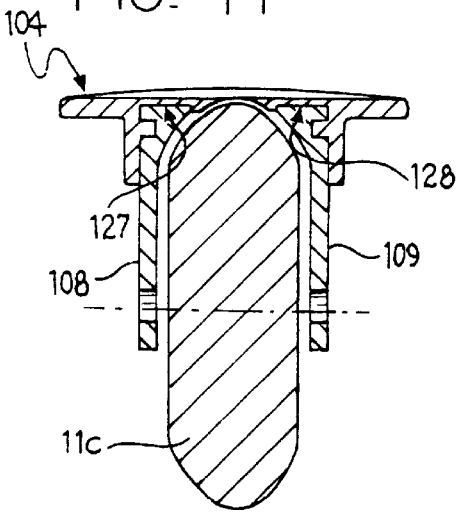
Figure 12:
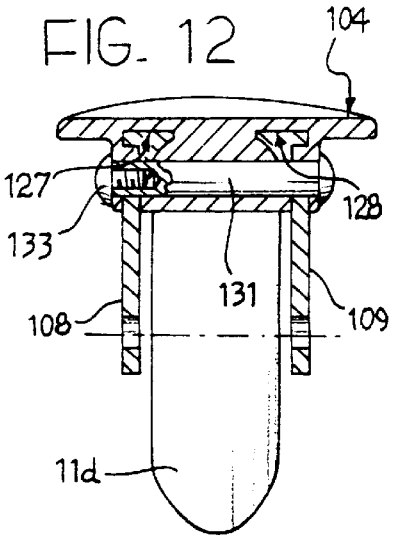

In FIGS. 1 to 3, a frame for supporting the wheels of an in-line skate structure 2 formed according to the present invention is generally indicated 1. The frame 1 has a predominantly elongate shape and comprises first and second blocks 3, 4 for fixing the frame 1 to respective heel and toe portions 5, 6 of a shell 7, shown only partially.

The frame 1 also has two parallel sides 8, 9 spaced apart and fixed to the blocks 3, 4 in the manner described in detail below.

Four wheels 11*a–d*, arranged in line and with parallel axes, are supported for rotation between the sides 8, 9, on the opposite side to the blocks 3, 4, by means of respective pins 10*a–d*.

The first block 3 has an approximately "T"-shaped cross-section with a plate-like upper body 12 defining a surface 12*a* for attachment to the shell 7. A web 13 extends from the body 12 and is connected to a lower body 14 defining two recesses 15, 16 for housing respective wheels 11*a*, 11*b*. Respective walls 17, 18 of the lower body 14 have corresponding first external "L"-shaped grooves 19, 20. These grooves 19, 20 are arranged in specularly symmetrical orientations.

The second block 4 has an approximately Grecian "P"-shaped cross-section with an upper body 21 defining a surface 21*a* for fixing the frame 1 to the toe portion 6. A lower body 22 defined in the block 4 has two recesses 23, 24 for housing the respective wheels 11*c, d*. Respective walls 25, 26 of the lower body 22 have corresponding second external "L"-shaped grooves 27, 28. The grooves 27, 28 are arranged with specularly symmetrical orientations corresponding to those of the first grooves 19, 20.

A respective appendage 29, 30 with an inverted "L"-shaped cross-section extending from a longitudinal edge of each side 8, 9 has a lip 31, 32 facing towards the opposite edge.

The appendages 29, 30 and the sides 8, 9 are shaped so as to mate with form coupling with the first and second grooves 19, 20, 27, 28 and with the walls 17, 18, 25, 26 of the blocks 3, 4, respectively.

It will also be seen that each appendage 29, 30 forms, with the first and second grooves, fixed joints between the side and the corresponding blocks. Moreover, each block 3, 4 is movable longitudinally along the sides 8, 9 by means of this form of coupling in order to be fixed in the desired position, for example, by means of screws or similar fixing means.

The blocks 3, 4 can thus be positioned adjustably along the sides 8, 9 and their relative spacing can therefore be selected in dependence upon the preselected shell-size. Moreover, identical blocks can fit pairs of sides of different lengths to produce wheel-support frames of different sizes.

The frame 1 is assembled by the provision, first of all, of the blocks 3, 4 of, for example, moulded plastics material and of the sides 8, 9, for example cut from light alloy sections in the various sizes required.

Each side 8, 9 is connected to the first and second blocks 3, 4 by the coupling of the appendages 29, 30 in the corresponding first and second grooves 19, 20 and 27, 28. The blocks 2, 3 are slid relative to the sides 8, 9 to the desired relative positions and are fixed there with screws, glues or similar known devices.

FIGS. 9 to 12 show a second embodiment of the skate structure of the invention, generally indicated 100.

Details similar to those of the preceding embodiment are indicated by the same reference numerals.

The skate structure 100 comprises a wheel-support frame 101 including two sides 108, 109 and a pair of blocks 103, 104 by means of which the sides 108, 109 are joined together and spaced apart to form the wheel-support frame.

As in the preceding embodiment, respective pairs of grooves, indicated 119, 120, and 127, 128 are provided on each block 103, 104 and are arranged with specularly symmetrical orientations.

Each side 108, 109 is shaped so as to mate with form coupling with the grooves 119, 120, 127 and 128 of the corresponding blocks. Respective through pins 130, 131, each having one internally-threaded end engaged by a corresponding screw 132, 133, are provided for locking each block 103, 104 relative to the sides 108, 109.

The invention thus solves the problem set, achieving numerous advantages in comparison with known solutions.

In particular, it is pointed out that the sides of the wheel-support frame of the invention are interchangeable with others of different sizes so that the frame can easily be adapted to shells of different sizes.

What is claimed is:

1. A skate structure comprising front and rear blocks adapted to be connected to a toe portion and a heel portion, respectively, of a skate shoe, a pair of separate elongated wheel support frame members, connecting means for slidably connecting said frame members to opposite lateral sides of said front and rear blocks and a plurality of in-line wheels rotatably supported between said frame members, said connecting means comprising a pair of longitudinally extending grooves formed in the opposite lateral sides of each of said front and rear blocks and a single inwardly extending appendage formed on a linear upper edge of each of said frame members, each appendage being slidably received within a respective groove of each of said front and rear blocks said grooves and appendages having a mating configuration for preventing lateral and vertical separation of said frame members from said blocks while permitting longitudinal sliding movement of the blocks relative to each other on the frame members to accommodate different size shoes prior to securing the blocks to the frame members.

* * * * *